United States Patent [19]

Giggard et al.

[11] Patent Number: 4,676,392

[45] Date of Patent: Jun. 30, 1987

[54] PAINT CAN HAVING PLURAL PLUG AND HANDLE SECURING ARRANGEMENT

[75] Inventors: Earl D. Giggard, Clarendon Hills; Nick S. Khoury, Worth; Donald R. Terrien, Naperville, all of Ill.

[73] Assignee: Continental Group, Inc., Stamford, Conn.

[21] Appl. No.: 270,468

[22] Filed: Jun. 4, 1981

[51] Int. Cl.[4] ..... B65D 39/00

[52] U.S. Cl. ..... 220/284; 220/308; 220/94 R

[58] Field of Search ..... 220/96, 94 R, 66, 67, 220/76, 44 R, 306, 275, 309, 310, 284, 307, 308, 359, 355, 358, DIG. 19; 229/43; 215/100 A, 304, 320

[56] References Cited

U.S. PATENT DOCUMENTS

| | | | |
|---|---|---|---|
| 1,593,633 | 7/1926 | Johnson | 220/355 X |
| 1,706,638 | 3/1929 | Thomas | 220/310 |
| 1,747,760 | 2/1930 | Duffy et al. | 215/320 |
| 1,929,433 | 10/1933 | Kenny | 220/94 R |
| 2,205,685 | 6/1940 | Conner | 220/310 |
| 2,428,371 | 10/1947 | Kinberg | 220/67 |
| 2,805,788 | 9/1957 | Allbright et al. | 220/94 R X |
| 3,073,478 | 1/1963 | Henchert | 220/306 X |
| 3,080,993 | 3/1963 | Livingstone | 220/307 |
| 3,155,233 | 11/1964 | Tupper | 220/306 X |
| 3,189,071 | 6/1965 | Balkema et al. | 150/55 |
| 3,220,591 | 11/1965 | Hidding | 215/100 A |
| 3,301,464 | 1/1967 | Amberg | 229/43 |
| 3,303,255 | 2/1967 | Bracey, Jr. | 264/249 |
| 3,322,298 | 5/1967 | Gach | 220/306 |
| 3,381,872 | 5/1968 | Holder et al. | 220/306 |
| 3,458,079 | 7/1969 | Gasbarra | 220/308 X |
| 3,792,797 | 2/1974 | Mrusek et al. | 220/308 |
| 3,804,289 | 4/1974 | Churan | 220/306 |
| 3,915,336 | 10/1975 | Spreng | 220/308 |
| 3,987,927 | 10/1976 | Serr et al. | 220/67 |
| 4,037,748 | 7/1977 | Stubbs, Jr. | 220/306 X |
| 4,046,282 | 9/1977 | Ruch | 220/307 X |
| 4,090,004 | 5/1978 | Tebbutt et al. | 220/359 X |
| 4,165,018 | 8/1979 | Giggard | 220/284 |
| 4,177,930 | 12/1979 | Crisci | 220/284 |
| 4,281,774 | 8/1981 | Mumford | 220/306 |
| 4,289,252 | 9/1981 | Helms | 220/306 X |

FOREIGN PATENT DOCUMENTS

| | | | |
|---|---|---|---|
| 2395200 | 1/1979 | France | 215/320 |
| 111400 | of 1964 | Czechoslovakia | 220/307 |

*Primary Examiner*—Stephen Marcus
*Assistant Examiner*—Robert M. Petrik
*Attorney, Agent, or Firm*—Charles E. Brown

[57] ABSTRACT

A paint can having a body with a curl at its upper open end and a plug having a downwardly open groove defined by an upright wall formed to fit within the open end of the body, a radial bight which in the closed position of the plug overlaps the curl and compress a sealing band thereagainst, and an outer flange with an inwardly offset lower portion which snaps under the curl, the lower edge of the flange having an inturned curl which is sprung into an annular groove in the body wall, the portion of the wall defining the said annular groove forming an annular internal rib on the body which enters a complimentary groove in the plug side wall. A handle is provided connected to a band encircling the body and abuts the lower edge of the outer flange of the plug in the closed position, the band sliding upwardly with the handle and extending into the body curl when the plug is removed.

19 Claims, 3 Drawing Figures

PAINT CAN HAVING PLURAL PLUG AND HANDLE SECURING ARRANGEMENT

BACKGROUND OF THE INVENTION

This invention relates to a reclosable metal paint can of the type which incorporate a plastic handle for carrying as well as for hanging the can as from a rung of a ladder.

DISCUSSION OF THE PROBLEM

Cost of the production of a standard metal paint can is a serious problem and particularly the complex manufacture of the plug locking ring which is double seamed to the can body and of the construction of the locking bead of the plug. Attempts have been made, with varying degrees of success, to provide a multiple interlocking arrangement between the bead of the plug and the walls of the groove of the locking ring on the can body.

Further problems are in the bail ears on the sides of the can body. The ears were clinched into pockets formed in the can body. When oil base paints were solely marketed, rust on the interior of the can was no problem. Water based latex paints required lacquering or otherwise coating the can interior. During clinching, the coating breaks and exposes the ferrous metal of the can, which rusts. Welding of the ears to the can also burns off such coatings. The costs of the assembly of the bails and the ears also are excessive.

SOLUTION OF THE PROBLEM AND SUMMARY OF THE INVENTION

The various problems have been solved by eliminating the welded or clinched ears on the can body and simplifying the body structure at the upper open end by forming the body wall with an outturned open curl and providing a plug with a dependent outer sphincteral locking band or segmented flange which with a peripheral opposing wall of the plug defines a downwardly open groove for receiving the upper edge of the can body wall including the curl, the locking band being offset inwardly at its lower portion and the steel material from which the cap is made providing a radially inward bias of the band sections toward the can body. The lower edge of the band is formed with an inturned curl which snaps into an external annular groove in the can body. The plug wall and securing band are interconnected by a radial ring like top web or bight which with adjacent portions of the band and plug wall confines an elastomeric gasket within the upper end of the groove, the gasket being pressed down in sealing engagement with the top edge of the curl at the top of the can body. In addition, the peripheral wall of the plug fits snuggly within the upper end of the can body and has an annular groove adjacent to its lower edge which snaps onto a can body rib forming the beforementioned external groove for the inturned curl of the locking band of the plug.

DESCRIPTION OF THE INVENTION

Figure 1:
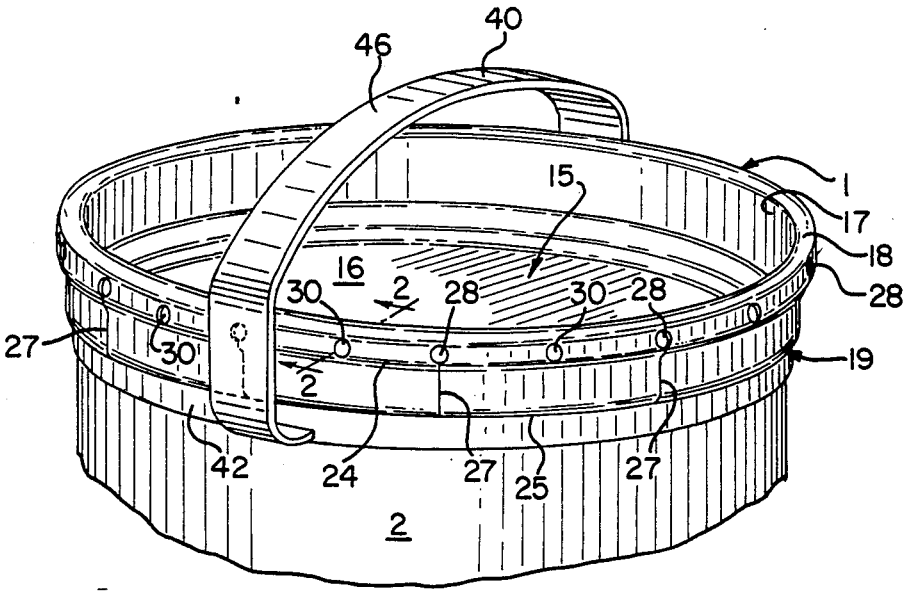
FIG. 1 is a fragmentary upper perspective view of the novel container.

The invention relates to a paint can 1 which has a cylindrical body wall 2 with a closed bottom (not shown).

The upper end portion 3 of the body is provided with an external annular groove 4 which is formed by deforming the can body to form an internal annular rib 5. The upper edge of the can body has an outturned curl 7 with an arcuate upper section 8, a downturned outer section 9 and an inturned lower section 10 which at its inner edge 11 is spaced from the body wall 2 to provide a downwardly open annular gap or slot 13.

A plug or lid 15 is provided as a closure for the can and comprises a center panel wall section 16, a peripheral vertical wall 17 extending upwardly substantially normal to wall section 16, an outturned bight portion or annular flange 18, and a downwardly extending locking band 19 at the outer edge of flange 18. The wall 17, flange 18 and band 19 define a downwardly open groove 20 for receiving the upper portion 3 therein in the closed position of the plug.

A sealing ring 22 of elastomer material is confirmed in the upper end of the groove 20 between adjacent portions of the wall 17 and band 19 and is compressed between the bottom side of the flange 18 and the upper section 8 of the curl.

The band 19 is offset intermediate its ends to provide an annular shoulder 24 which extends beneath and lower section 10 of the body curl in engagement therewith which thus provides a secondary or auxiliary locking means for the cap.

The lower end of the locking band 19 has an inturned curl 25 which snaps into the groove 4, it being understood that the material from which the cap is made, which is preferably steel, has an inherent resiliency characteristic for biasing the band radially inwardly. The band is segmented, being divided by a series of vertical slits 27 which terminate in stress reducing apertures 28 at their upper ends.

Alternating with the slits, there are provided tool-receiving apertures 30 in each band segment 31 for admitting the end of a screw driver 32 or like tool which is adapted to be inserted with its pointed end 33 and wedged between the top or upper section 8 of the body curl 7 and the marginal edge thereabove the hole 30 and then levered upwardly to pry the plug or lid 15 off the can body.

The plug is provided at the lower edge of its wall 17 with an annular groove 35 complemental to the arcuate contour of the can body rib 5, the rib snapping into the groove 35 when the lid is pressed down to its fully closed position which is accomplished by pressing down on the cap flange 18 whereupon the curls on the band sections wedge over the curl on the can body and then pass under the can body curl and move downwardly and into the can body groove at which time the rib 5 snaps into groove 35.

Figure 2:
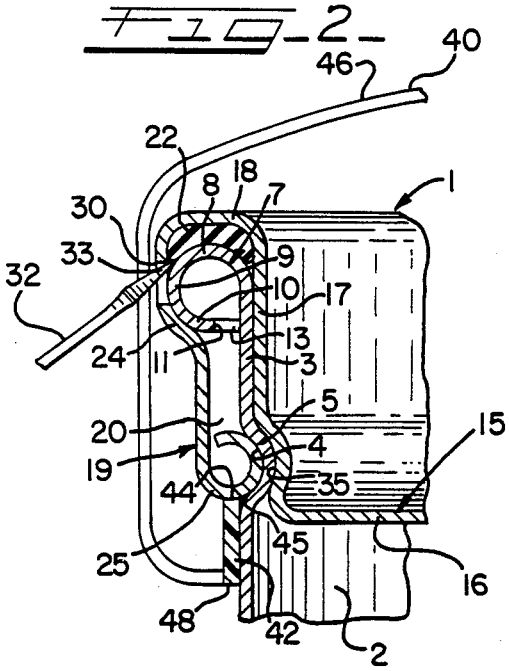
FIG. 2 is a cross-sectional view taken essentially on line 2—2 of FIG. 1.
Figure 3:
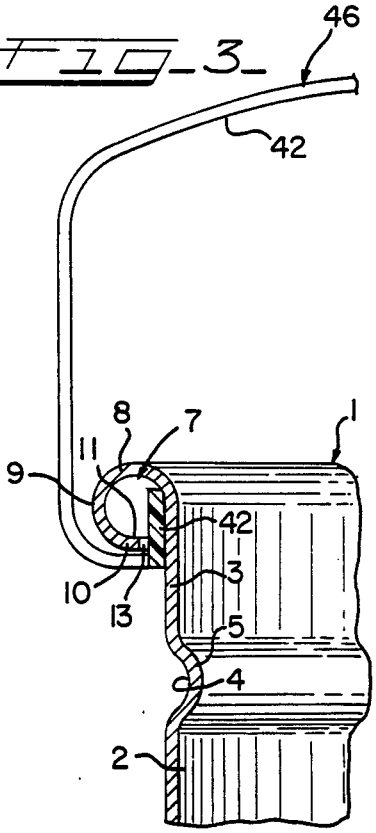
FIG. 3 is the same cross-section as FIG. 2, with the plug removed and the handle raised.

Another novel feature of the invention is the provision of a handle assembly 40 which is made of resilient plastic material and includes a band 42 which is sleeved over the can body, and in the closed position of the plug has its upper edge 44 butted against the underside 45 of the bottom curl 25 on the locking band of the plug. Thus the flat plastic strip handle 46 is in its lowered stowed position as seen in FIGS. 1 and 2. In the extended or raised position, the band 42 slides upwardly and enters its upper portion into the gap 13 so that it is held captive between the curl 7 and the upper portion of the can body and cannot accidentally escape. The ends of the handle 46 are attached to diametrically opposite points of the band 42 adjacent to its lower edge 48.

What is claimed is:

1. A container comprising a body wall of substantially uniform thickness and having an upper wall portion terminating in an upper edge, said upper wall portion prior to receiving a closure including common means spaced below said upper edge by an upper tubular part and providing an annular groove on one side of said portion and an annular rib on the opposite side of said portion, a removable closure plug having a channel shaped peripheral section including radially spaced outer and inner portions releasably snugly embracing in the closed position of said plug said upper wall portion and having means for releasable resilient locking engagement with both said rib and groove.

2. The invention according to claim 1 and said peripheral section of said plug comprising a bight flange interconnecting said inner and outer portion, and sealing means stressed between said bight flange and said upper edge of said body wall.

3. The invention according to claim 2 and said upper edge comprising an outturned curl and said outer portion of the plug being offset radially inwardly and in the closed position of the plug engaging with the underside of said curl.

4. The invention according to claim 1 and said upper edge comprising an outturned curl and said outer portion of the plug being offset radially inwardly and in the closed position of the plug engaging with the underside of said curl.

5. The invention according to claim 1 wherein said closure plug is formed of metal and said radially spaced outer and inner portions are shaped.

6. The invention according to claim 1 wherein said groove is arcuate in cross section.

7. The invention according to claim 1 wherein closure plug means which engages in said groove is fully seated in said groove.

8. The invention according to claim 1 wherein closure plug means which engages in said groove is fully seated in said groove and is in the form of a curl.

9. The invention according to claim 1 wherein said closure plug is of uniform thickness.

10. The invention according to claim 1 wherein said closure plug is of uniform thickness and is formed of metal.

11. The invention according to claim 1 wherein said closure plug is formed of sheet material and said radially spaced outer and inner portions are shaped.

12. A container comprising a body wall having an upper portion terminating in an upper edge, said upper portion prior to receiving a closure including common means below said upper edge providing an annular groove on one side of said portion and an annular rib on the opposite side of said portion, a removable closure plug having a shaped peripheral section including radially spaced outer and inner portions releasably snugly embracing in the closed position of said plug said upper wall portion and having means for releasable resilient locking engagement with both said rib and groove, said groove being on the external side of said portion and the rib being on the internal side thereof, and said outer portion being segmented and having means for facilitating opening of said closure including tool-admitting apertures disposed above said rib and groove in proximity to the upper edge of said body wall whereby a tool may be inserted through said apertures and fulcrumed against said upper edge of the body wall for prying said closure off.

13. The invention according to claim 12 and said upper edge comprising an outturned curl and said outer portion of the plug being offset radially inwardly and in the closed position of the plug engaging with the underside of said curl.

14. A container comprising a cylindrical body wall with an upper edge curl turned outwardly and having a lower portion radially spaced from the external side of said body wall and defining a downwardly open gap therewith, a handle assembly for the container comprising a band encircling said body, said band having upper and lower edges, a handle extending over the top of the container and having opposite ends connected to the external side of said band at diametrically opposite points thereof adjacent to the lower edge thereof, a closure having abuttment means for engaging in the closed position with said container the upper edge of the band while said band is disposed on the container below said abuttment means, said handle while said band engages said abuttment means being in stowed position close to the top of the container, said closure being separable from said container for opening it and thereupon disengaging said abuttment means from said band, said band upon disengagement from said abuttment means being slidable upwardly and entering with its upper edge into said gap for thus positively interlocking the handle assembly with the container.

15. The invention according to claim 14 and said body wall and closure having means releasably interlocking with each other, and said interlocking means including said abutment means.

16. The invention according to claim 15 and elastomeric sealing means compressed between said upper edge curl and said closure, and said interlocking means maintaining said sealing means in compression.

17. The invention according to claim 14 and said closure having inner and outer portions embracing said body wall, and means on the body wall and each of said portions for interlocking engagement with each other.

18. The invention according to claim 17 and said interlocking means comprising a plurality of said interlocking assemblies on said outer portion and said container wall.

19. The invention according to claim 14 and said closure and container being made of metal and said handle assembly being made of plastic.

* * * * *